US007614930B2

(12) United States Patent
Berkey et al.

(10) Patent No.: US 7,614,930 B2
(45) Date of Patent: Nov. 10, 2009

(54) INFLATABLE CHILD ACTIVITY CENTER

(75) Inventors: Cindy L. Berkey, Honey Brook, PA (US); Michael A. Dotsey, Pottstown, PA (US); Thomas J. Pollack, West Chester, PA (US); William B. Bellows, Wyomissing, PA (US); Brian Kincaid, Philadelphia, PA (US)

(73) Assignee: Graco Children's Products Inc., Atlanta, GA (US)

( * ) Notice: Subject to any disclaimer, the term of this patent is extended or adjusted under 35 U.S.C. 154(b) by 378 days.

(21) Appl. No.: 11/555,358

(22) Filed: Nov. 1, 2006

(65) Prior Publication Data

US 2007/0123141 A1 May 31, 2007

Related U.S. Application Data

(60) Provisional application No. 60/732,643, filed on Nov. 3, 2005.

(51) Int. Cl.
*A63H 3/06* (2006.01)

(52) U.S. Cl. ..... 446/220; 446/227; 5/655; 472/134; 482/35

(58) Field of Classification Search ..... 446/220–227, 446/71, 72, 77, 78, 80, 153, 487; 482/35; 297/136, 137, 256.16, 274, 452.41, 255, 297/DIG. 11; 472/129, 134, 135; 5/655, 5/93.2, 99.1, 655.3

See application file for complete search history.

(56) References Cited

U.S. PATENT DOCUMENTS

| | | | | |
|---|---|---|---|---|
| 43,972 A | | 8/1864 | Coldwell | |
| 100,083 A | | 2/1870 | Stephan | |
| 616,697 A | | 12/1898 | Cowles et al. | |
| 2,506,890 A | | 5/1950 | Wilson | |
| 2,704,111 A | | 3/1955 | Wunderlich | |
| 3,147,972 A | | 9/1964 | Borsuk | |
| 3,493,228 A | * | 2/1970 | Hicks et al. | 472/134 |
| 4,226,467 A | | 10/1980 | Boudreau | |
| 4,240,224 A | * | 12/1980 | Katzman et al. | 446/197 |
| 4,805,902 A | | 2/1989 | Casagrande | |
| 5,403,239 A | | 4/1995 | Zimmers | |
| 5,628,275 A | * | 5/1997 | Casey | 119/28.5 |
| 5,688,211 A | | 11/1997 | Myers | |
| 5,732,999 A | * | 3/1998 | Petrie | 297/136 |

(Continued)

FOREIGN PATENT DOCUMENTS

| | | |
|---|---|---|
| DE | 24 21 474 | 11/1975 |
| JP | 48 068367 | 9/1973 |

*Primary Examiner*—Gene Kim
*Assistant Examiner*—Scott Young
(74) *Attorney, Agent, or Firm*—Lempia Braidwood LLC

(57) ABSTRACT

A child activity center has a body structure that can be deflated and inflated. The body structure has a bottom end and a top end spaced upward from the bottom end when inflated. An opening is in the top end of the body structure and a child retaining region is accessible through the opening and defined within the body structure when inflated. A sealed air space is in the body structure and an air inlet is in communication with the air space and configured to permit inflation of the body structure. A seat is suspended in the retaining region and configured to support a child in the retaining region above the bottom end.

19 Claims, 10 Drawing Sheets

U.S. PATENT DOCUMENTS 5,930,854 A * 8/1999 O'Neill et al. ..... 5/655
6,425,842 B1 * 7/2002 Stern et al. ..... 482/35
6,574,806 B1 6/2003 Maher
6,637,814 B1 * 10/2003 Bellows et al. ..... 297/137
6,682,139 B2 * 1/2004 Bellows et al. ..... 297/136
6,715,826 B2 * 4/2004 Bellows et al. ..... 297/136
6,854,799 B1 2/2005 Asbach
7,287,768 B2 * 10/2007 Myers et al. ..... 280/87.051
7,290,303 B2 * 11/2007 Mead et al. ..... 5/655
2003/0143904 A1 * 7/2003 Morrow et al. ..... 441/12

* cited by examiner

INFLATABLE CHILD ACTIVITY CENTER

RELATED APPLICATION DATA

This patent is related to and claims priority benefit of previously filed U.S. Provisional Application Ser. No. 60/732,643, which was filed on Nov. 3, 2005, and was entitled "Child Activity Center." The entire content of the previously filed provisional application is incorporated herein by reference.

BACKGROUND OF THE INVENTION

1. Field of the Disclosure

The present disclosure is generally directed to child entertainment devices, and more particularly to an inflatable activity center for a child.

2. Description of Related Art

Parents have long dealt with the problem of entertaining and stimulating their infants and toddlers. Many devices are known in the art that attempt to accomplish these goals. One type of product that is commonly used for infants and young toddlers is known as an activity center or entertainer. A typical entertainer has a generally cylindrical upper tray with a top opening. A sling seat is typically positioned in the opening to support a child in a standing position. The upper tray is supported above a ground surface so that the infant can play with various toys and other objects on the tray. A typical activity center is formed of hard plastic material and is fairly large. Thus, the activity center takes up a lot of room and is difficult to store when not in use.

Some activity centers permit a child to jump or bounce up or down within the central opening of the upper tray and have wheels or feet that can resiliently move up and down. Some activity centers also permit the child to move or walk within the activity center, if their feet can touch the ground. However, known child activity centers are typically configured to accommodate children within a relatively small size and weight range. As an infant grows, they outgrow the activity center. Caregivers are forced to store the activity center or hand off the activity center to another family because it is no longer of use to them. As noted above, the conventional activity center is relatively large and difficult to store and, thus, takes up a lot of space within the home. When transported, such as when the activity center is handed off to another family, the activity center is difficult to transport because of its relative large size. Additionally, families that are currently using an activity center typically will not travel with the activity center because of the relative large size. Thus, the activity centers are typically only enjoyed within the home environment.

Conventional activity centers also are typically relatively noisy when being used because of the nature of the hard plastic material used to form the product. Additionally, conventional activity centers can cause an occasional bruise or bump when an infant contacts the hard plastic material during play, either when playing in the activity center or merely playing around the activity center.

BRIEF DESCRIPTION OF THE DRAWINGS

Objects, features, and advantages of the present invention will become apparent upon reading the following description in conjunction with the drawing figures, in which.

DETAILED DESCRIPTION OF THE DISCLOSURE

An inflatable child activity center is disclosed herein is a portable entertainment and stimulation device suitable for infants and toddlers. The inflatable device disclosed herein solves or improves upon one or more of the above-noted and other problems and disadvantages known with respect to various known child entertainers. The disclosed inflatable device provides a bounce feature that permits an infant or toddler using the device to bounce or jump up or down for enjoyment and stimulation. The disclosed inflatable device also has a tray that can be provided with a variety of different toys and other stimulating objects for the occupant. The disclosed inflatable device can also be modified so that it can be enjoyed and used by small infants as well as larger sized toddlers. Thus, the device can be retained and used in the home for a longer period of time in comparison to a conventional activity center. The disclosed inflatable device can be safer and quieter than a conventional activity center because the product is essentially formed from softer, resilient materials filled with air pressure instead of hard plastic materials for the structure of the device. When the disclosed inflatable device is in the portable condition, it is relatively small and can be packed away when not in use. Thus, the disclosed device will require less space for storage, stowing, or travel. These and other features and advantages of the present invention will become apparent upon reading this disclosure.

Figure 1:
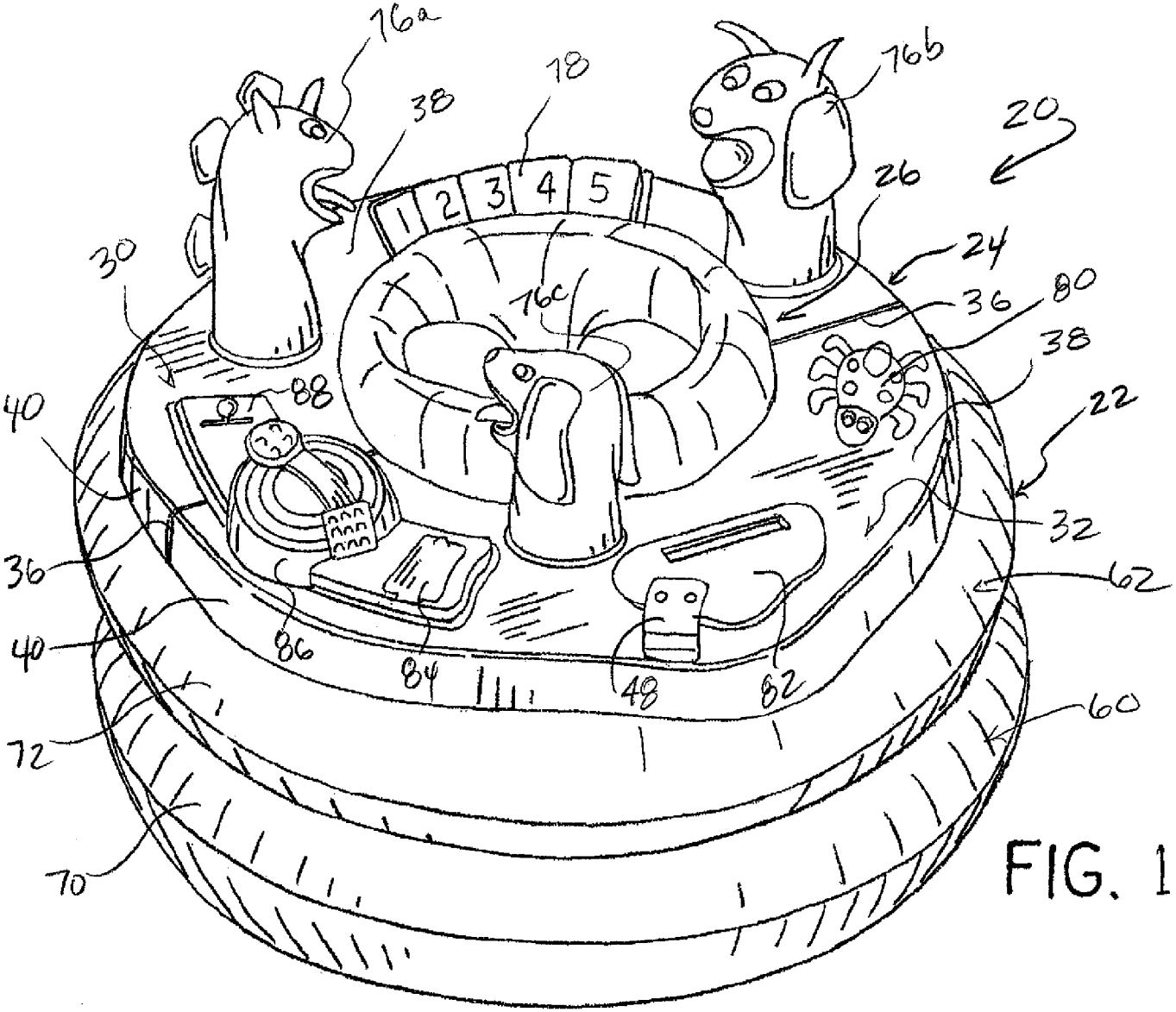
FIG. 1 is a perspective view of one example of an inflatable child activity center constructed in accordance with the teachings of the present invention.

Turning now to the drawings, FIG. 1 shows a perspective view of one example of an inflatable activity center 20 constructed in accordance with the teachings of the present invention. The device 20 in his example generally has an inflatable body structure 22 and an entertainment tray 24 positioned at a top end of the body structure. The activity center 20 also includes a sling seat assembly 26 positioned in a central opening 28 in the entertainment tray 24.

Those having ordinary skill in the art will recognize that the shape, configuration, and function of the body structure 22 can vary considerably and yet fall within the spirit and scope of the present invention. Similarly, those having ordinary skill in the art will recognize that the shape, structure, function, and configuration of the entertainment tray 24 and the play or toy aspects of the tray can also vary considerably and yet fall within the spirit and scope of the present invention. The disclosed activity center examples are provided herein merely for the purposes of illustration and not necessarily to limit the scope of the present invention.

Figure 2:
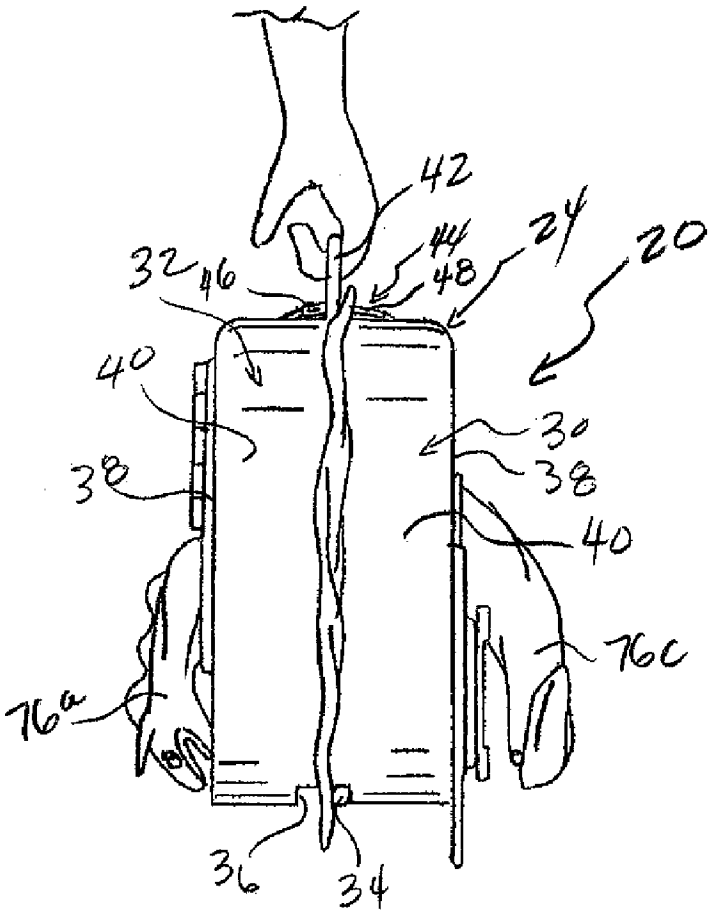
FIG. 2 is an end view of the inflatable child activity center shown in FIG. 1 while in a folded portable configuration.
Figure 12:
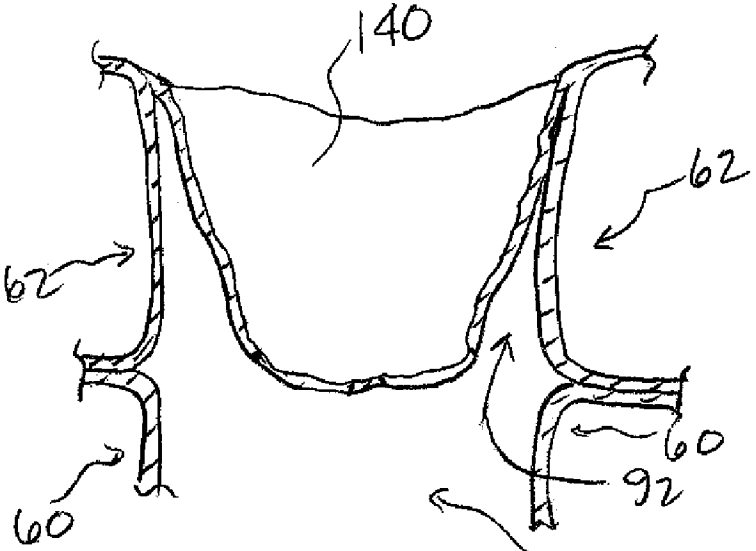
FIG. 12 shows a cross-section of a portion of another example of an inflatable child activity center constructed in accordance with the teachings of the present invention.

Before describing the details of some of the components of the child activity center 20 in this example, we first describe the general process for setting up and breaking down the inflatable activity center. One particular advantage of the disclosed inflatable activity center is that it is collapsible when the air is let out and can be reconfigured or folded to a compact portable configuration. The primary supporting element for the body structure 22 is air pressure. When no air pressure is provided to the body structure, the inflatable activity center 20 can be collapsed to a very compact, highly portable configuration. In the disclosed example, the entertainment tray 24 is split into two portions including a first tray section 30 and a second tray section 32. As shown in FIG. 2, the two tray sections 30 and 32 are hingedly connected to one another by one or more pivot joints or hinges 34 along a seam or joint 36. The seam is shown in FIG. 1 and the hinges are shown in FIG. 2.

When the body structure 22 is devoid of air as shown in FIG. 2, the two tray sections 30 and 32 can be folded toward one another, thus, permitting the entertainment tray 24 to be folded in half. Each of the tray sections 30 and 32 includes a top panel 38 and a skirt wall 40 depending from a perimeter of the top panel. As shown in FIG. 2, the skirt walls 40 of the tray sections 30 and 32 confront and abut one another when in a folded configuration. A cavity is created between the interior bottoms surfaces of the top panels 38 and the skirt walls 40 of the two sections 30 and 32. When the body structure 22 is devoid of air, the entire body structure can be collapsed and housed within the interior cavity of the tray sections 30 and 32. A handle 42 can be configured as a part of the activity center 20 to permit a user to easily hold and carry the folded activity center. In this example, the handle 42 is provided projecting from the skirt wall 40 of the tray section 32.

As will be evident to those having ordinary skill in the art, the configuration and structure of the tray sections 30 and 32, the seam or joint 36, the hinges 34, the top panels 38, the skirt walls 40, and the handle 42 can vary considerably and yet fall within the spirit and scope of the present invention. In this example, the tray sections 30 and 32 of the entertainment tray are constructed of generally rigid plastic materials and can be molded using conventional processes. In other examples, even the entertainment tray portion of the activity center can be formed from flexible or at least semi-rigid materials such as stuffed fabric, rubber, or even the same inflatable material used to fabricate the body structure 22. The intended purpose of the entertainment tray 24 is to provide and present objects to entertain and stimulate the occupant of the activity center as described below, and yet enhance, assist, or at least not inhibit the collapsibility and portability of the activity center when reconfigured to a folded or collapsed condition.

In this example, a latch 44 can also be provided as a part of the entertainment tray or body structure so that the activity center 20 can be physically retained in the portable or collapsed configuration. In this example, the latch 44 includes first and second fabric straps 46 and 48 that can join with one another to hold the activity center in the folded or portable configuration. The straps 46 and 48 can be provided with any type of suitable fastener such as buckles, latches, buttons, snaps, hook and loop (Velcro) fasteners, or the like in order to retain the straps in a connected or latched configuration. Alternatively, the latch 44 can be employed without straps 46 and 48 and instead employ latching features directly as a part of the body structure 22 or the entertainment tray 24 as desired.

Figure 3:
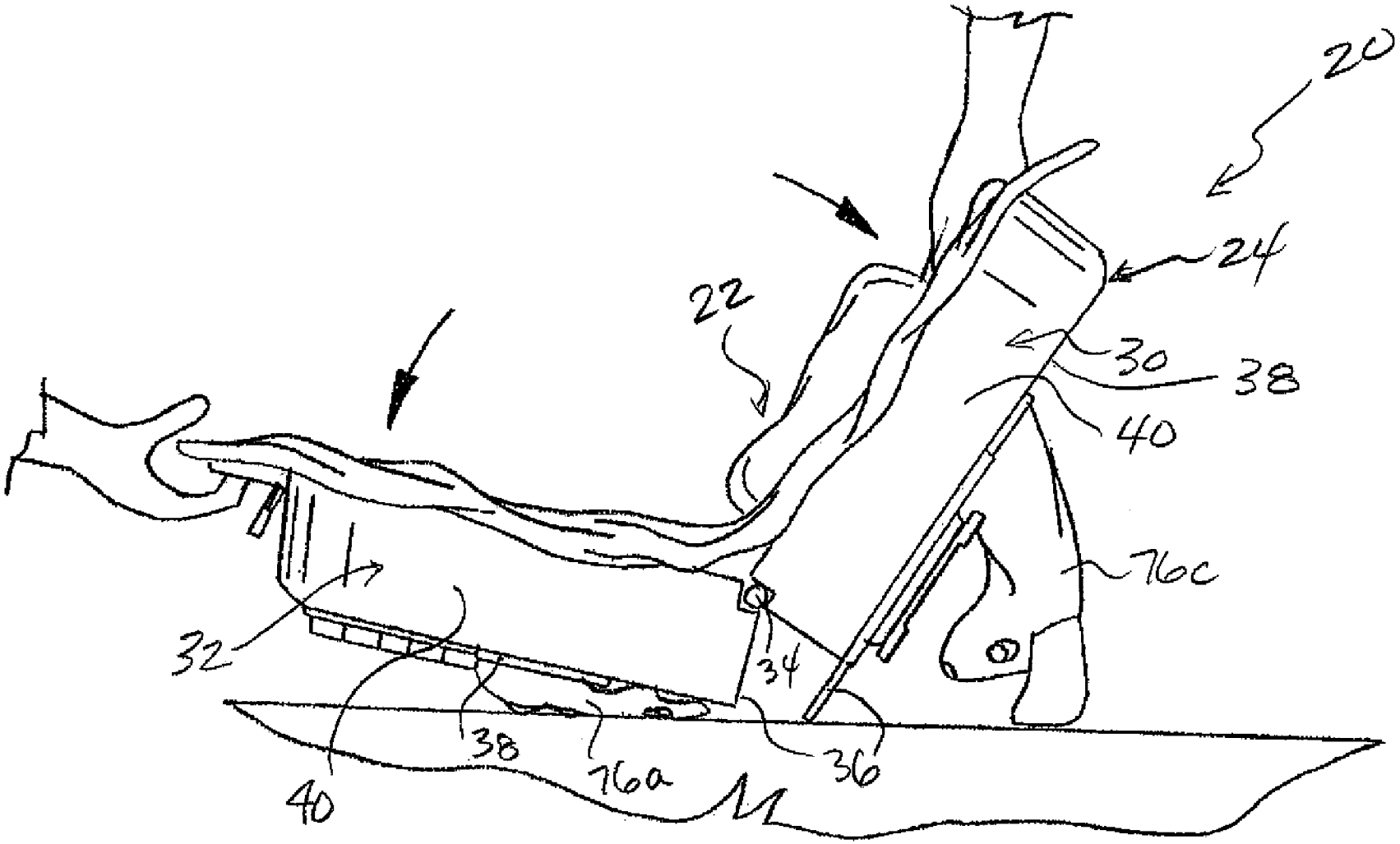
FIG. 3 shows the inflatable child activity center of FIG. 2 as it is being opened.

FIG. 3 shows a caregiver beginning to deploy the inflatable activity center 20 from the fully folded or collapsed portable configuration of FIG. 2. In this example, the user simply opens the closed tray sections 30 and 32. If a latch 44 is present, the user must release the latch and then pivot the two tray sections 30, 32 about the hinges 34 to open the product and to expose the collapsed body structure 22.

Figure 4:
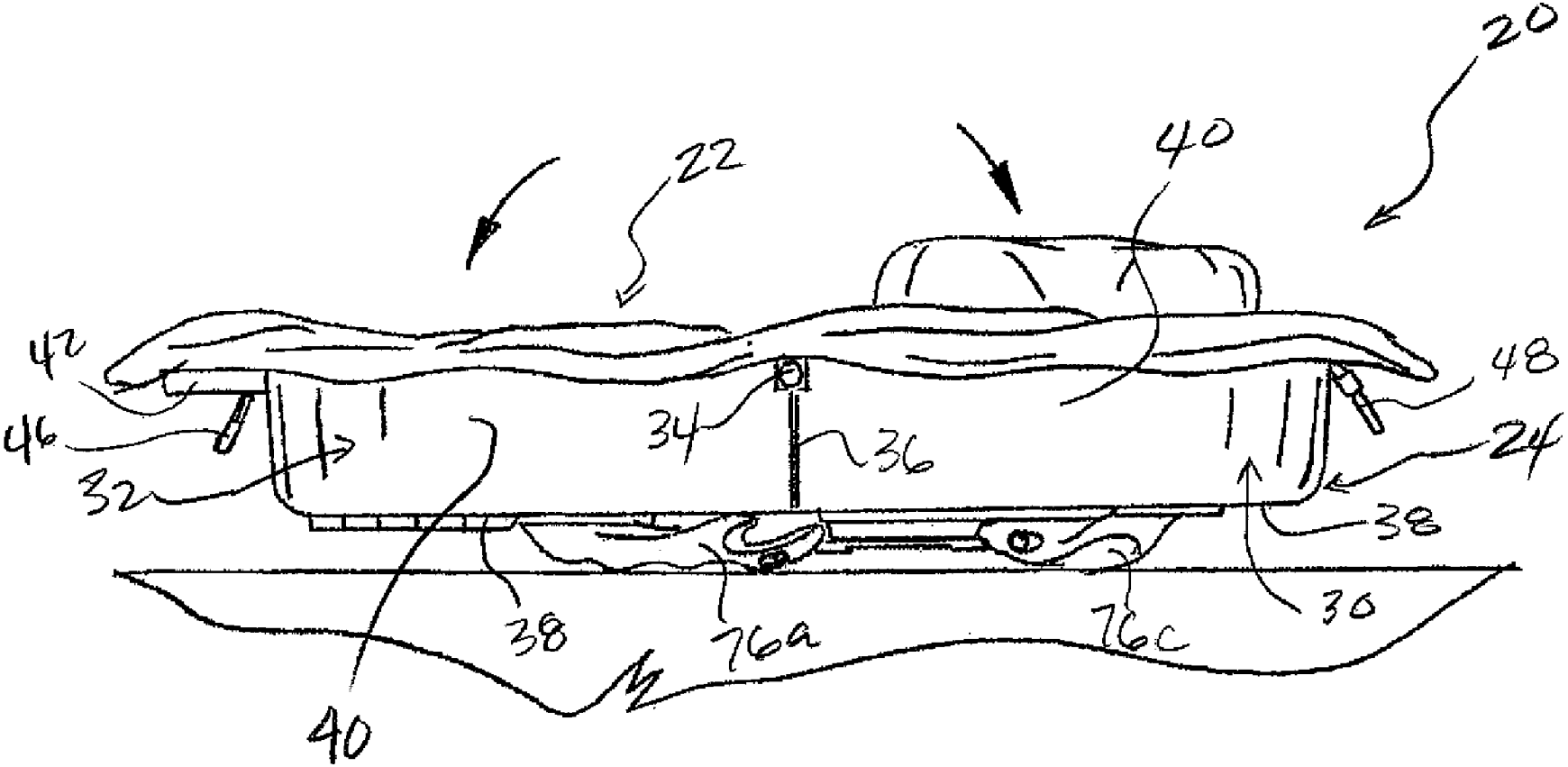
FIG. 4 shows the inflatable child activity center of FIG. 3 after it has been completely opened but not yet turned upright.
Figure 5:
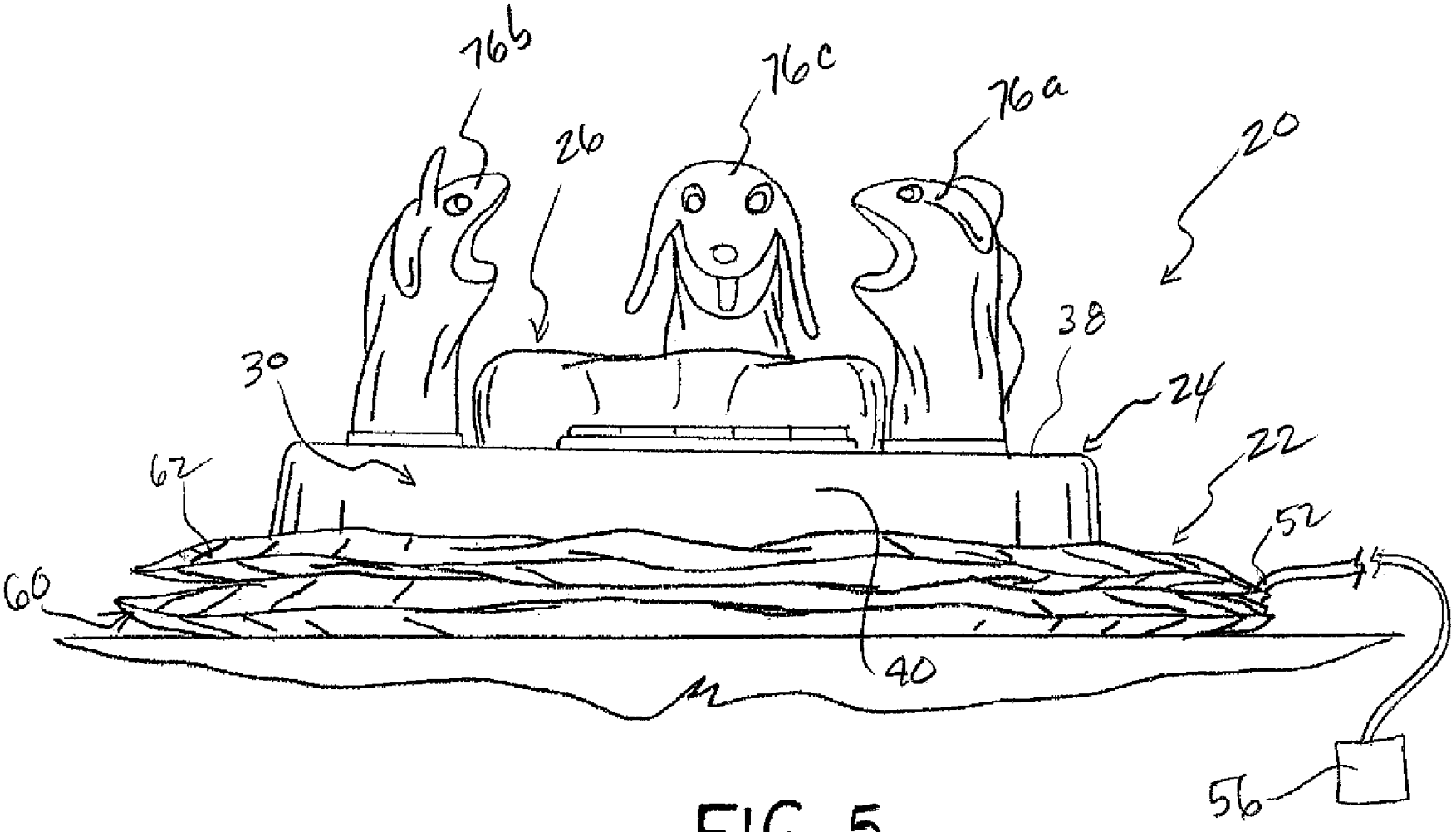
FIG. 5 shows the inflatable child activity center of FIG. 4 after being turned upright and ready for inflation.
Figure 6:
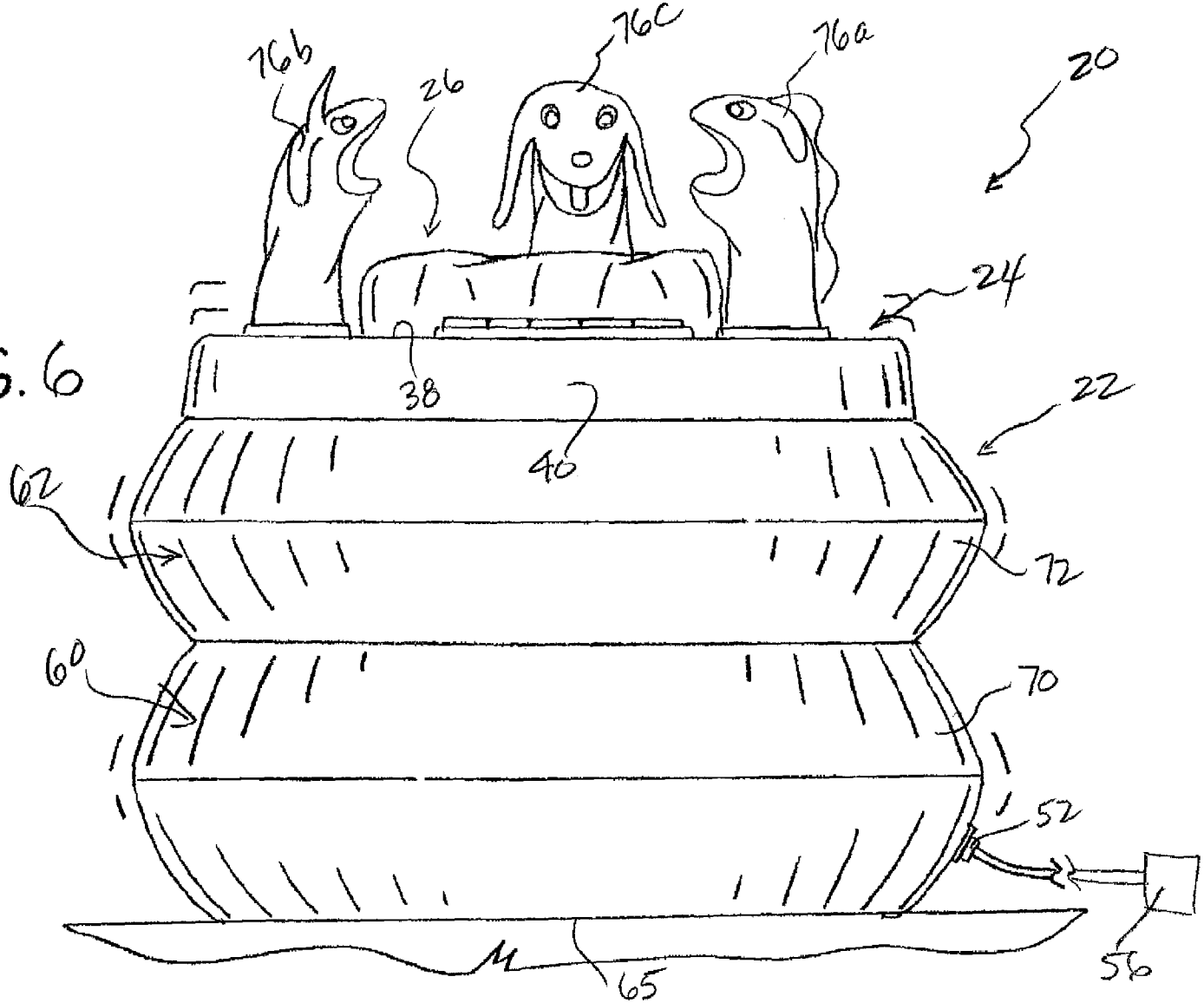
FIG. 6 shows the inflatable child activity center as it is being inflated.

FIG. 4 shows the activity center 20 completely unfolded, but with the entertainment tray 24 in an inverted configuration wherein inflation of the body structure has not yet begun to occur. FIG. 5 shows the activity center 20 after being turned upright so that the body structure 22 is positioned beneath the entertainment tray 24. FIG. 5 also shows the activity center 20 at the beginning of the inflation process and FIG. 6 shows the activity center 20 near completion of the inflation process. As the body structure 22 fills with air, the entertainment tray 24 is deployed above a ground surface and is supported by the body structure.

Figure 7:
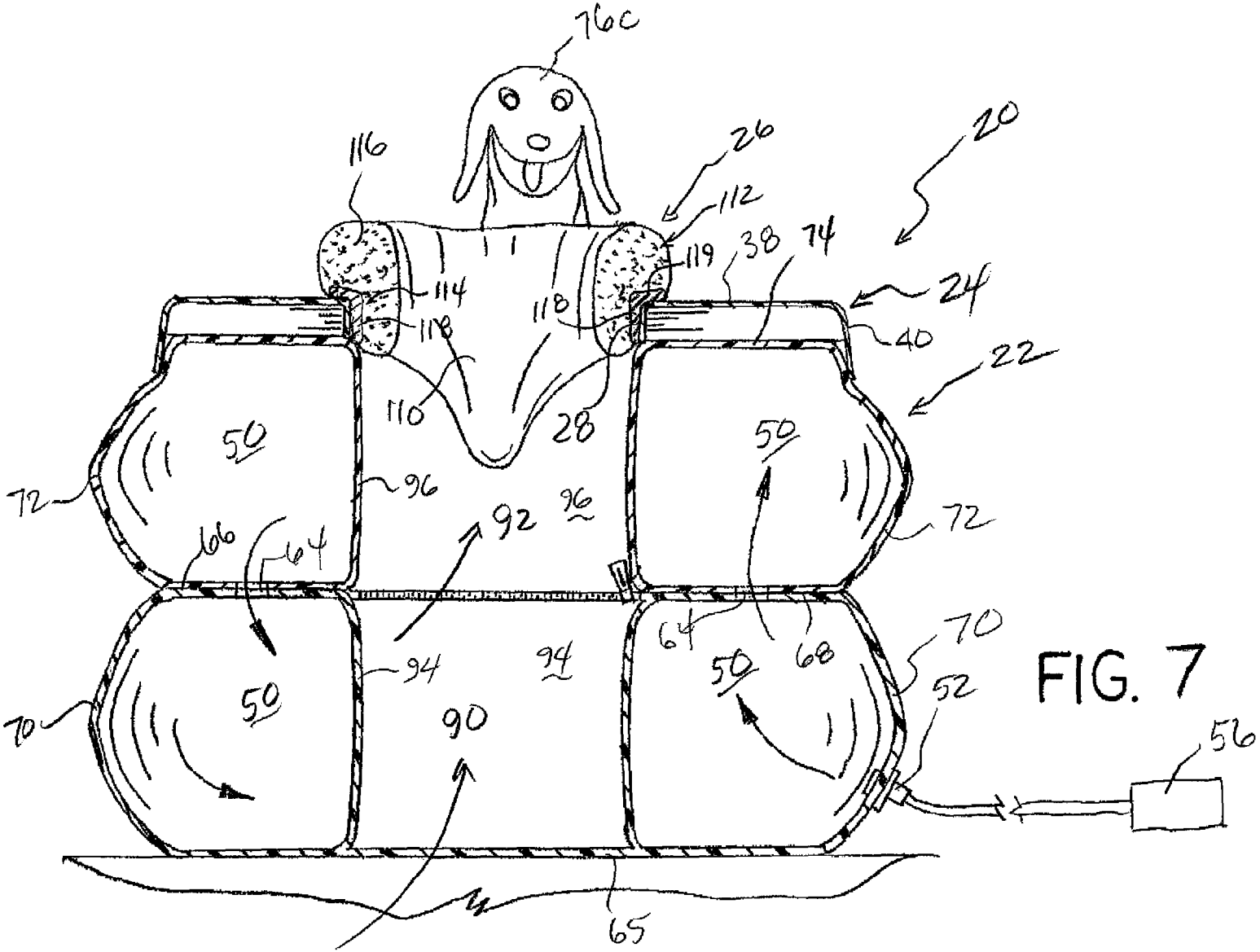
FIG. 7 is a cross-section of the inflatable child activity center taken along line VII-VII of FIG. 1 after the device has been fully inflated.

FIG. 7 is a cross-section of the activity center 20 during the final stages of inflation of the body structure 22. When the body structure 22 has been fully inflated, the activity center 20 is ready for use. As will be evident to those having ordinary skill in the art, the detailed structure and configuration of the body structure 22 can vary considerably from the disclosed example. However, the majority of the features of the present invention will be described herein referring to FIGS. 1-10 and the activity center 20.

The inflatable body structure 22 can be formed from a flexible, air tight material constructed having a continuously closed interior space 50. An air inlet 52 is provided through a wall 54 of the body structure 22. The air inlet 52 can take on many forms and yet fall within the spirit and scope of the present invention. The air inlet 52 can be a conventional pop-in/pull-out valve used on conventional, manually inflatable products such as beach balls and air mattresses. The air inlet 52 can alternatively employ a much more complicated mechanical air valve structure, a quick connect device, or the like. The air inlet 52 can thus be configured so that the body structure 22 must be blown up manually by a caregiver or can be of a type suitable for automatic pressurization from an air compressor 56 or other device. If the body structure 22 includes an automatic inflation system, the air compressor 56 can optionally be provided as a part of the activity center that is sold commercially.

The inflatable body structure 22 can be formed from any suitable flexible material. In one example, the material can be a unitary layer of an inexpensive plastic material such as rubber, polyethylene (PE), polypropylene (PP), polyvinylchloride (PVC), or the like. In another example, the material can be a more expensive laminate material with a fabric or other exterior layer and one or more other layers of an air impervious quality. The material of the body structure 22 may be sufficiently flexible so that the structure can be collapsed, folded, crushed, or otherwise reduced in size when deflated to minimize the size of the interior space 50 when devoid of air, such as is shown in FIG. 5. As depicted in FIGS. 6 and 7, the body structure 22 in this example includes a bellows configuration or dual innertube configuration. In this example, the body structure 22 includes a first annular ring section 60 at the bottom of the structure. The shape and configuration of the ring section 60 can be configured to ensure that the body structure 22 rests flat and securely against a floor surface. The body structure 22 in this example also has a second annular ring section 62 positioned vertically on top of the ring section 60. As shown in FIG. 7, air passages 64 extend between the two ring structures 60 and 62 to create a singular integral interior space 50 in the body structure.

The body structure can be manufactured and assembled to achieve virtually any desired configuration or shape. In this example, the two ring structures 60 and 62 are attached to one another. The material of the body structure 22 can be created in parts or sections and then assembled. The sections or parts can be cut and sewn, glued, mechanically welded, molded, or otherwise formed and attached to create the shape of the body structure desired. The bottom ring 60 in this example has a closed off bottom surface 65 that rests on the floor. In an alternative example, the bottom surface 65 need not be present and, instead, the bottom surface of just the ring portion of the activity center 20 can rest on the ground. In this example, a top surface 66 of the bottom ring 60 and a bottom surface 68 of the top ring 62 are connected to one another forming a unitary body structure. The air passages are formed in these adjoined surfaces of the rings. In alternative embodiments, the entire top side 66 and bottom side 68 of the rings can be eliminated, thus eliminating the need for the air passages 64. Instead, a side wall 70 of the bottom ring and a side wall 72 of the top ring can be sewn or otherwise joined together at an exterior joint 73 to create the body structure 22 in this example. Clearly, many different alternate configurations and constructions for the body structure 22 can be achieved.

In this example, the entertainment tray 24 is adhered to a top side 74 of the top ring 62. Again, the entertainment tray 24 can be connected to the body structure 22 in any suitable manner so long as the entertainment tray stays connected to the body structure 22 during use. Thus, the entertainment tray can be permanently affixed to a portion of the body structure. Alternatively, the entertainment tray can be removably attached to the body structure using latches, buckles, straps, buttons, snaps, hook and loop fasteners, or the like.

As will be evident to those having ordinary skill in the art, the entertainment features provided as a part of the entertainment tray 24 can vary considerably and yet fall within the spirit and scope of the present invention as well. The toys and other entertainment articles can vary according to the age, gender, entertainment or stimulation goal, and the like. The toys can be learning centered or purely entertainment or amusement centered. The toys can be interchangeable or replaceable and aimed at children of different ages as well. A variety of examples of generic toys 78, 80, 82, 84, 86, and 88 are provided on the entertainment tray 24 merely for illustration purposes herein.

As represented in FIGS. 2-6, the entertainment tray 24 can be provided with one or more inflatable toys that are in communication with the interior space 50 of the body structure 22. This can be accomplished by providing the entertainment tray 24 with a hole or opening formed therein. A toy or other amusement device can be connected to a portion of the body structure and in communication with the air space and that portion of the toy can also extend through the opening in the tray. In this example, three generic animal heads 76*a*, 76*b*, and 76*c* project through the entertainment tray 24 and, when inflated as represented in the series of FIGS. 2-6, stand upward from the entertainment tray for the amusement of the occupant of the activity center 20. Again, the heads 76*a*, 76*b*, 76*c* or other inflatable amusement devices can be connected to a portion of the body structure 22 using any suitable means such as sewing, gluing, mechanical welding, molding, or the like. Additionally, the number (if any), shape, configuration, and position of the various inflatable toys or amusement devices projecting upward from the tray can vary considerably from the examples shown.

In the disclosed example, each of the bottom and top rings 60 and 62 includes an interior central opening 90 and 92, respectively. These openings coincide vertically and align with the center opening 28 in the entertainment tray 24 as shown in the cross-section of FIG. 7. The center openings 90 and 92 are bounded by inner side walls 94 and 96 of the bottom and top rings 60 and 62, respectively. The body structure 22 in the disclosed example is configured to render the activity center 20 adaptable to accommodate either an infant or a larger sized toddler within the center of the body and supported by the seat assembly 26.

Figure 8:
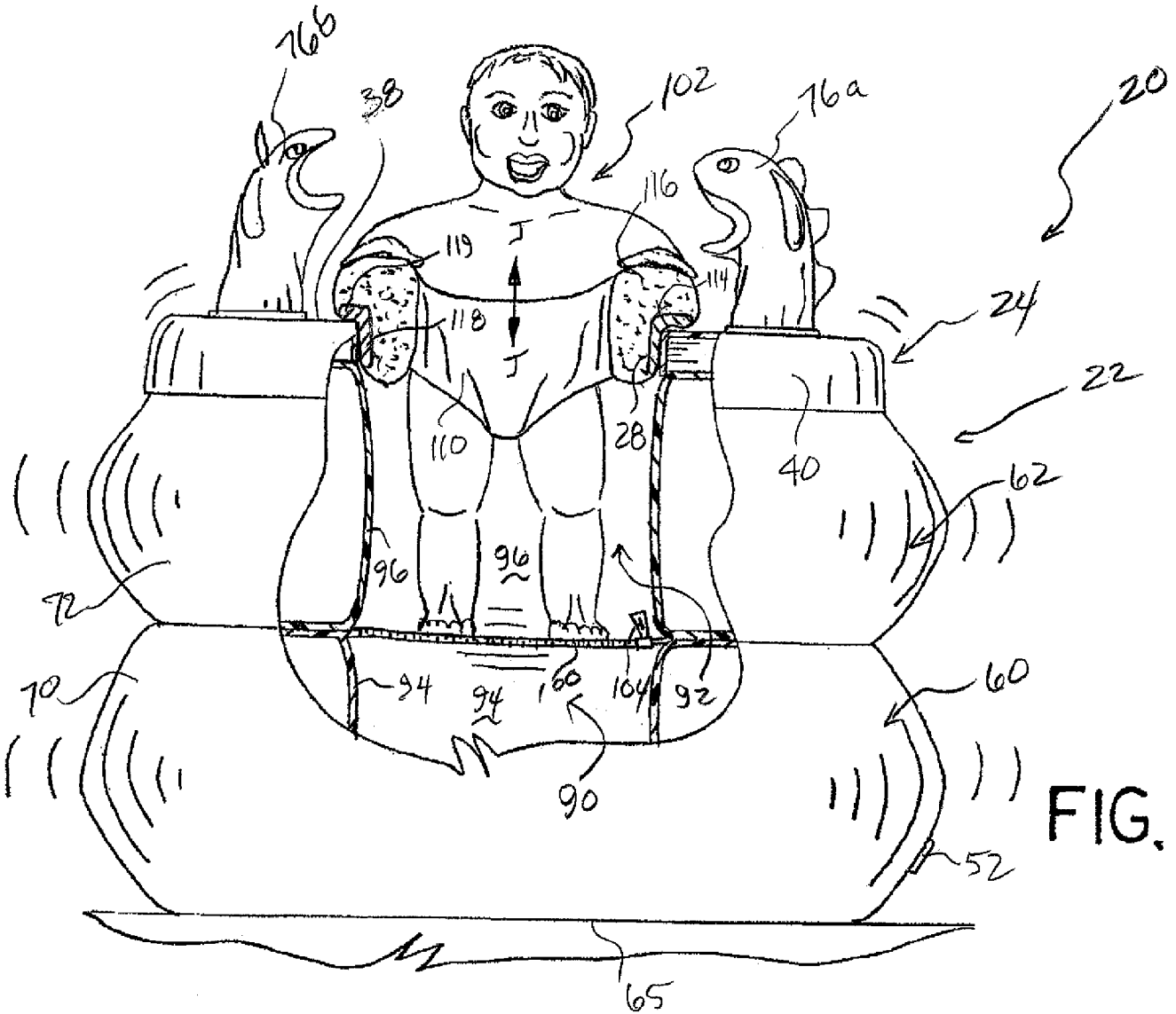
FIG. 8 shows a partial cut away view of the inflatable child activity center shown in FIG. 1 and configured to support an infant according to one example of the present invention.

As shown in the cut away view of FIG. 8, a divider or platform 100 of the body structure 22 can extend across the body structure and separate or close off the body structure between the two center openings 90 and 92. The platform 100 can be formed from the same material as the rest of the body structure or can be formed from a different more resilient material, if desired. The divider or platform 100 can have a somewhat bouncy or resilient nature to create a trampoline effect within the body structure 22. The platform 100 can be positioned so that an infant as depicted in FIG. 8 can stand on the platform 100 when supported by the sling seat assembly 26. As shown in FIG. 8, the infant can jump up and down on the platform 100 in the direction of the arrows J. The resilient nature of the body structure 22 in combination with the air pressure in the interior space 50 can enhance the bounce effect, and thus the degree of entertainment and stimulation, of the activity center 20 for the infant 102.

Figure 9:
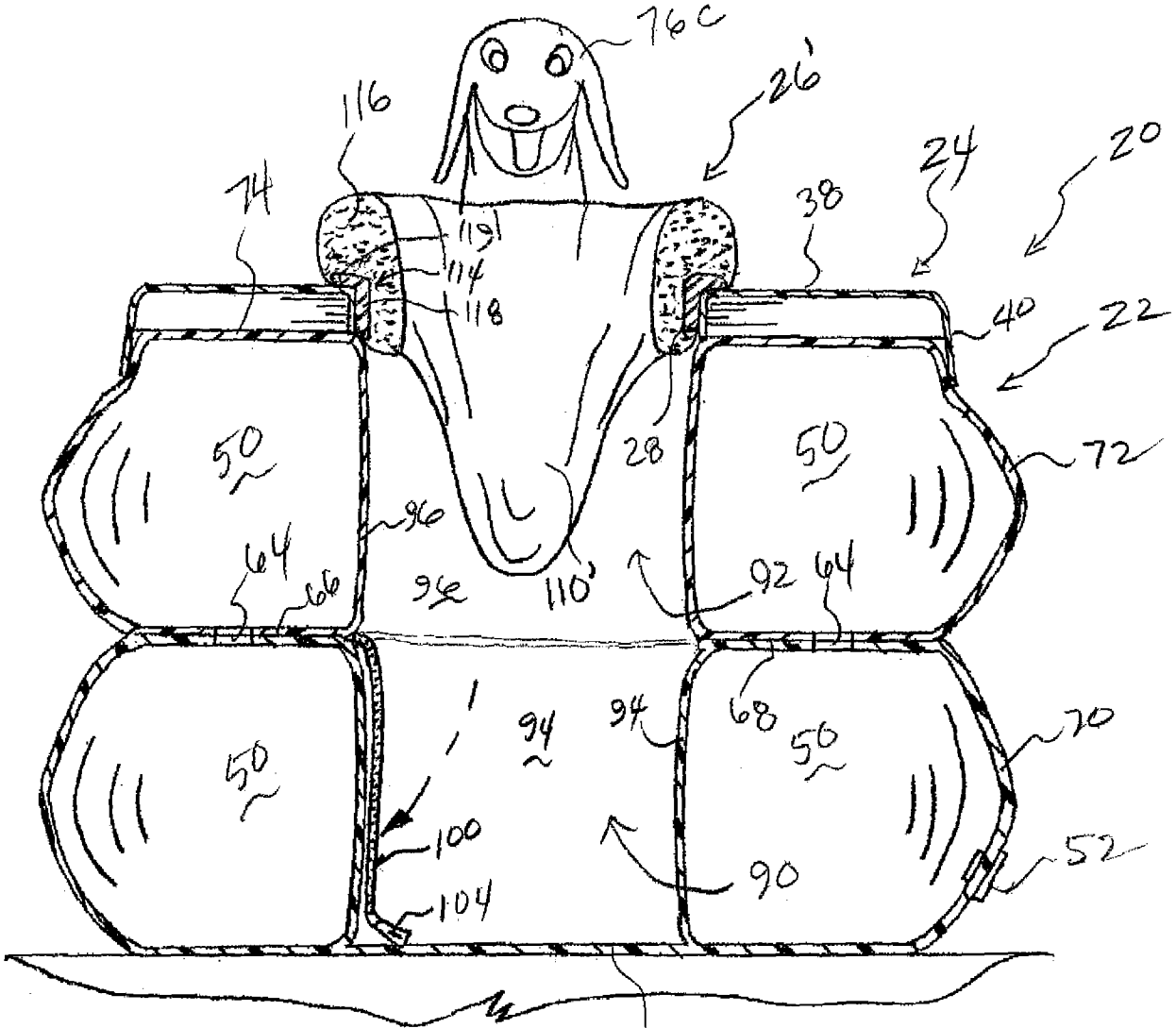
FIG. 9 shows the inflatable child activity center of FIG. 7 after being reconfigured to accommodate a larger sized toddler according to another example of the present invention.

The platform 100 can be an integral portion of the body structure 22 and/or permanently fixed to a portion of the body structure such as the top edge of the inner side wall 94 of the bottom ring 60 in this example. In such an example, the activity center 20 would be adapted to accommodate only an infant or a child up to a certain size. In another example, the platform 100 can be formed as a removable or at least partly detachable structure so that the platform can at least be moved out of the way. By doing so, the entire interior of the center openings 90 and 92 will be open from the top of the activity center to the floor or to the bottom surface 65 of the bottom ring 60. As shown in FIG. 9, the platform 100 can at least be partly detachable so that it can be dropped down and out of the way clearing space to the bottom surface 65 of the activity center. In this example, a zipper 104 can be provided that can attach or detach the platform material to other parts of the body structure 22. The fastener, such as the zipper 104, need not be air tight since the openings 90 and 92 within the inner side walls 94 and 96 are not part of the interior space 50 that maintains the air pressure in the disclosed example. Clearly, other fastening devices such as hook and loop fasteners (VELCRO), snaps, or the like could alternatively be utilized to secure the platform 100 to the body structure 22. The material of the platform 100 can also vary considerably and yet fall within the spirit and scope of the present invention. The material can be a solid material or a tight grid mesh material, or other materials as desired.

The sling seat assembly 26 in one example can be detachable from the activity center 20. The activity center can be provided with one or more different sling seat assemblies that are interchangeable with one another. Each can be configured to accommodate different size children. In the disclosed example, the sling seat assembly 26 includes a fabric sling seat 110 and a padded support 112 that can surround and be secured within or over the center opening 28 of the entertainment tray 24. The padded support 112 can take on numerous configurations and constructions and yet fall within the spirit and scope of the present invention. As shown in FIG. 7, the padded support can include a rigid frame 114 and soft padding 116 covered by a fabric layer or other material. The frame can be configured to seat within the center opening 28 of the entertainment tray as shown. The frame 116 in this example includes a depending skirt 117 that fits within the center opening 28 to align the seat assembly with the opening. The frame in this example also has an annular flange 119 extending radially outward from a top edge of the skirt. The flange 119 overlaps the top panel 38 of the entertainment tray 24 surrounding the center opening 28. Thus, the sling seat assembly will not fall through the opening and will be positioned firmly and securely within the center opening. The support 112 can also have suitable fasteners so that the support is attachable and detachable via application of force to the entertainment tray 24. In one example, VELCRO fasteners could be utilized to assist in holding the sling seat assembly 26 in place on the activity center.

Figure 10:
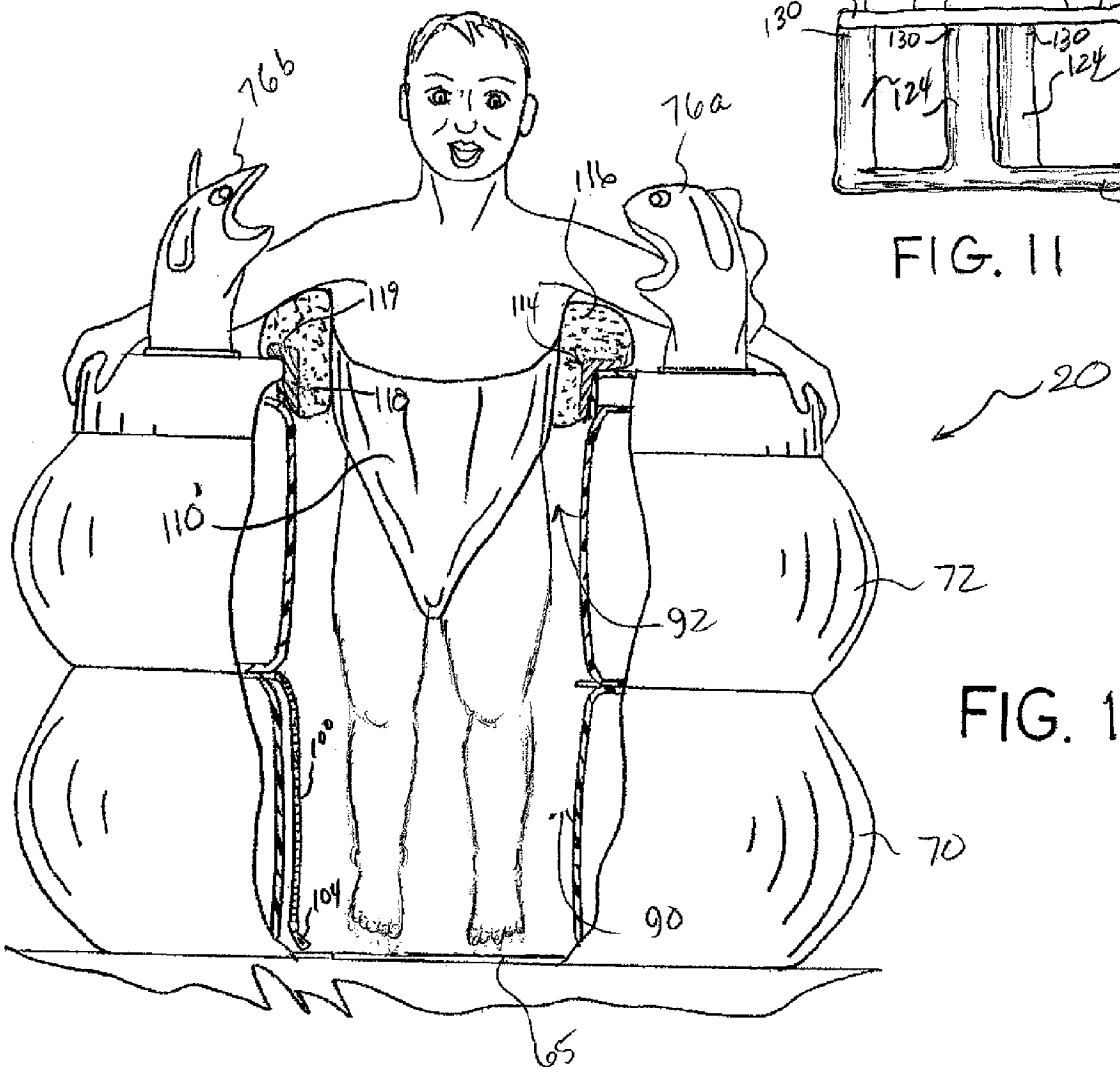
FIG. 10 shows a partial cut away view of the inflatable child activity center of FIG. 9 and supporting a larger sized toddler according to another example of the present invention.

One size sling seat assembly 26 can be provided to accommodate an infant as depicted in FIGS. 8 and 9 and a second size sling seat assembly 26' can be provided to accommodate a larger sized toddler as depicted in FIG. 10. The sling seat 110 or 110' can be different for each of the seat options. One of the sling seats can drop lower within the openings 90 and 92 to properly position a toddler within the activity center 20. For safety purposes, it may be undesirable for a large sized toddler to be placed in the activity center in such a manner that their feet can rest squarely on the floor under the bottom surface 65. The sling seat 10' can be configured so that a toddler is supported as shown in FIG. 10 with their feet just above the ground surface. The toddler can still use their movement, weight, and momentum to create bounce via the resilient nature of the body structure 22 and the air pressure within the interior space 50.

Figure 11:
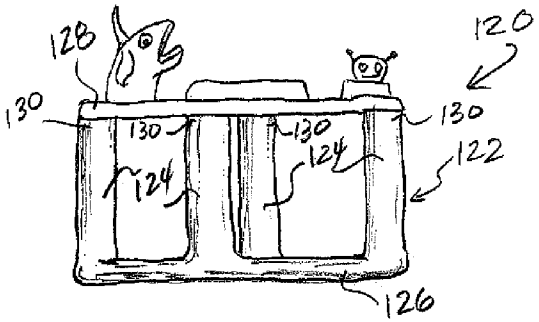
FIG. 11 shows a perspective view of another example of an inflatable child activity center constructed in accordance with the teachings of the present invention.

As noted above, the body structure 22 need not be configured as shown in the example of FIGS. 1-10. Many other configurations and constructions for an inflatable activity center 20 can be fabricated within the spirit and scope of the present invention. FIG. 11 illustrates just one of many possible different configurations for the body structure 22. In this example, an activity center 120 has an alternative body structure 122 that utilizes four upstanding pillars 124 integrally connected to an inflatable base 126. In this example, the inflatable base is somewhat similar to the bottom ring 60 of the prior example. However, different base constructions and configurations can also be utilized. For example, a plastic base similar to the construction of the entertainment tray 24 could be utilized in this configuration with only a small annular inflatable ring provided at the top, the middle, and/or the bottom of the four pillars 124 to interconnect and create a singular air space among the body structure 122 components in such an example, the product could collapse so that the lower plastic base and the entertainment tray could collapse on one another and capture the four inflatable pillars in an interior of the two plastic components. In this disclosed example, a plastic entertainment tray 128 is coupled to top ends 130 of the four pillars 124 and can be adhered to the pillars in any suitable manner. The entertainment tray 128 can be foldable as in the prior example. The four pillars 124 and the inflatable base 126 can collapse when devoid of air and lie against the entertainment tray 28, or inside a cavity of the entertainment tray when folded or collapsed.

In another example, the seat assembly 26 can be formed instead as an integral sling seat 140 as a part of the material of the body structure 22. As shown, the seat configuration can be formed as part of the material when forming the body structure prior to it being assembled. The integral seat 140 then is not removable unless it is detachable similar to the platform 100 described previously. However, use of an integral seat configuration such as the seat 140 eliminates the need for the seat assembly 26 and its variations as described previously.

In any of the embodiments disclosed herein, flaps, tabs, fabric loops, hook and loop fasteners, snaps, permanent mechanical bonding or welding, or the like can be utilized to secure the plastic components, such as the entertainment tray 128 or 24 to the body structures 122 or 22 in the disclosed examples. In an alternative example, the entertainment trays disclosed herein can be replaced by entertainment products permanently affixed to or provided as an inflatable part of the body structures. The trays need not be plastic trays but, instead, could be objects provided directly on a part of the body structure. These objects can be toys formed from plastic, fabric, stuffed fabric, air inflated, and the like.

The body structures disclosed herein can also vary considerably. The body structures can be formed to look like recognizable objects to enhance the entertainment value. For example, the body structures 22 can be created to resemble a known character or form when inflated. The body structure can take on the form of animals, cars, airplanes, boats, or other forms within a virtually unlimited list of options. The inflatable body structures can be created to resemble most anything and yet fall within the spirit and scope of the present invention. The particular form and configuration of the body structure is not intended to be particularly limited within the spirit and scope of the present invention. However, the structure must still provide an activity center function in that a child can be supported within a portion of the inflated body structure with access to entertainment and stimulation features provided on the activity center.

Although certain inflatable child activity centers have been described herein in accordance with the teachings of the present disclosure, the scope of coverage of this patent is not limited thereto. On the contrary, this patent covers all embodiments of the teachings of the disclosure that fairly fall within the scope of permissible equivalents.

What is claimed is:

1. A child activity center comprising:

a body structure that can be deflated and inflated and has a bottom end and a top end spaced upward from the bottom end when inflated;

an opening in the top end of the body structure when inflated;

a child retaining region accessible through the opening and defined within the body structure when inflated;

a sealed air space in the body structure;

an air inlet in communication with the air space and configured to permit inflation of the body structure;

a seat suspended in the retaining region and configured to support a child in the retaining region above the bottom end;

an entertainment tray on the top end when the body structure is inflated, the entertainment tray having two rigid sections that can be folded toward one another when the body structure is deflated; and a cavity created between the two rigid sections when folded, wherein the body structure can be collapsed and disposed within the cavity when deflated.

2. A child activity center according to claim 1, further comprising:

an entertainment area disposed on the entertainment tray with at least one object intended to entertain a child positioned in the child retaining region.

3. A child activity center according to claim 1, wherein the body structure further comprises:

a bottom ring with an annular air space forming part of the body structure air space; and a top ring above the bottom ring and having an annular air space forming at least part of the body structure air space, wherein the top ring surrounds at least part of the retaining region.

4. A child activity center according to claim 3, wherein the bottom ring surrounds another part of the retaining region.

5. A child activity center according to claim 4, further comprising:

a platform suspended below and spaced from the seat and above the bottom end, wherein the platform creates a lower extremity of a first configuration of the retaining region, and wherein the resilient platform can be repositioned to present a second lower extremity at the bottom end of the body structure to create a second larger configuration of the retaining region.

6. A child activity center according to claim 1, further comprising:

a resilient platform positioned to form a lower extremity of the retaining region beneath the seat but above the bottom end.

7. A child activity center according to claim 6, wherein the resilient platform is removable or displaceable to increase the size of the retaining region to accommodate a taller child than can fit within the retaining region with the resilient platform forming the lower extremity.

8. A child activity center according to claim 1, further comprising:

at least one inflatable toy with a toy air space that is inflated when the body structure is inflated and that projects above a top surface of the entertainment tray when inflated.

9. A child activity center according to claim 1, further comprising:

a plurality of interchangeable seats each mountable on and removable from the body structure and each configured to accommodate a child of a different size in the retaining region.

10. A portable child activity center comprising:

a flexible body structure that can be inflated to an in-use configuration and deflated to a portable configuration, wherein the body structure has a bottom end configured to rest on a support surface and a top end spaced upward from the bottom end in the in-use configuration;

a child retaining region within the body structure and accessible through the top end when inflated;

a plurality of sling seats each removable from and mountable to the activity center and each sized to reconfigure the retaining region to accommodate a child of a different size when mounted to the activity center;

an air space in the body structure;

an air valve in communication with the air space to selectively inflate and deflate the body structure; and an entertainment area on the top end of the body structure with at least one child amusement object thereon, wherein the activity center can be collapsed to a compact portable configuration when deflated.

11. A portable child activity center according to claim 10, wherein the entertainment area further comprises:

an entertainment tray positioned on the top end of the body structure when inflated and having a top surface; and an access opening through the entertainment tray and open to the child retaining region when inflated, wherein the amusement object is on the top surface of the entertainment tray.

12. A portable child activity center according to claim 11, further comprising:

a secondary opening through the entertainment tray; and an inflatable toy with a toy air space in communication with the body structure air space, wherein the toy is inflated and projects through the secondary opening from the top surface of the entertainment tray when the body structure is inflated.

13. A portable child activity center according to claim 10, wherein the entertainment area further comprises:

an entertainment tray positioned on the top end of the body structure when inflated, wherein the entertainment tray has two sections that can be folded toward one another when the body structure is deflated and collapsed to the portable configuration.

14. A portable child activity center according to claim 13, further comprising:

a cavity formed between the two sections when folded, wherein the body structure can be collapsed and disposed within the cavity when deflated.

15. A portable child activity center according to claim 14, further comprising:

a handle on the entertainment tray that is deployed for carrying the activity center when the body sections are folded and the activity center is collapsed to the portable configuration.

16. A portable child activity center according to claim 10, further comprising:

a handle on part of the activity center that is deployed for carrying the activity center when in the collapsed portable configuration.

17. A portable child activity center according to claim 10, further comprising:

a sling seat deployed within the retaining region when the body structure is inflated.

18. A portable child activity center according to claim 17, further comprising:

a resilient platform attached positioned within the body structure above the bottom end and below the sling seat, wherein the resilient platform creates a lower extremity of a first configuration of the retaining region, and wherein the resilient platform can be repositioned to create a second lower extremity of a second larger configuration of the retaining region.

19. A portable inflatable child activity center comprising:

a flexible body with an inflatable air space that can be inflated to configure the body in an in-use condition and deflated to configure the body in a portable limp condition, the body having a bottom end configured to rest on a support surface when inflated and a top end spaced upward from the bottom end when inflated;

a child retaining region within and surrounded by the body and accessible through the top end when inflated;

a sling seat assembly having a seat suspended within the child retaining region; and an entertainment tray on the top end and having two sections movable relative to one another between a play orientation when the body is inflated and a portable orientation when the body is deflated, wherein the entertainment tray forms a top play surface and an access opening to the child retaining region in the play orientation and forms a storage cavity within the two sections in the portable orientation, and wherein the body can be stowed in the cavity when deflated, the entertainment tray creating a protective carrying case for the deflated child activity center.

* * * * *